United States Patent [19]

Sarh et al.

[11] 4,154,539

[45] May 15, 1979

[54] SHOT PEENING MACHINE WITH MIXER

[75] Inventors: Branko Sarh, Hamburg; Bernd Haberkorn, Pinneberg, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 774,537

[22] Filed: Mar. 4, 1977

Related U.S. Application Data

[63] Continuation-in-part of Ser. No. 662,933, Mar. 1, 1976, abandoned.

[30] Foreign Application Priority Data

Mar. 7, 1975 [DE] Fed. Rep. of Germany ..... 2509960

[51] Int. Cl.[2] ..... B24C 7/00; E05D 13/02

[52] U.S. Cl. ..... 366/276; 51/424; 73/53

[58] Field of Search ..... 29/90 A; 72/53; 51/424, 51/425, 429, 436; 366/276

[56] References Cited

U.S. PATENT DOCUMENTS

| | | | |
|---|---|---|---|
| 24,673 | 7/1859 | Stubbs | 259/100 |
| 225,832 | 3/1880 | Hobbs | 259/100 |
| 571,678 | 11/1896 | Myers | 259/100 |
| 2,053,627 | 9/1936 | Parker | 259/101 |
| 2,078,139 | 4/1937 | Hanson | 259/101 X |
| 3,103,765 | 9/1963 | Nolan | 51/425 |
| 3,343,304 | 9/1967 | Eppler | 51/436 |
| 3,378,237 | 4/1968 | Horton | 259/101 |
| 3,436,866 | 4/1969 | Nye | 51/429 |

*Primary Examiner*—Billy S. Taylor

*Attorney, Agent, or Firm*—W. G. Fasse; W. W. Roberts

[57] ABSTRACT

A suspension of solid particles in a liquid is produced and maintained by periodically moving agitating elements up and down in an elongated, flat bottom container. The agitating elements may, for example, be baffle plates, grids or the like, which are moved up and down either in a linear or in an angular movement. Preferably, two sets of agitating members are arranged so as to pass through each other in their periodic up and down movements. A carriage having mounted thereon a pump and a spray nozzle is movable alongside the elongated container with an intake of the pump reaching into the container without interfering with the moving agitating elements.

11 Claims, 7 Drawing Figures

Fig.1
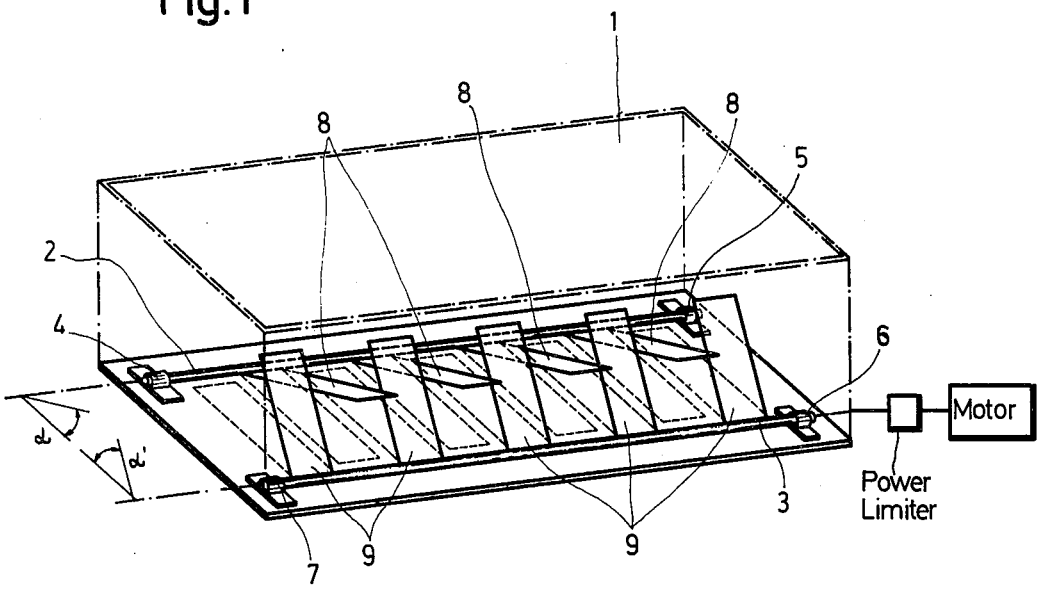
Fig.4
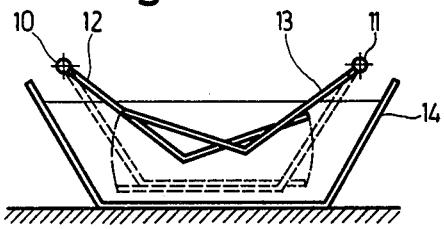
Fig.5
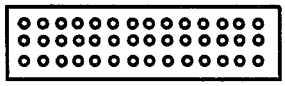
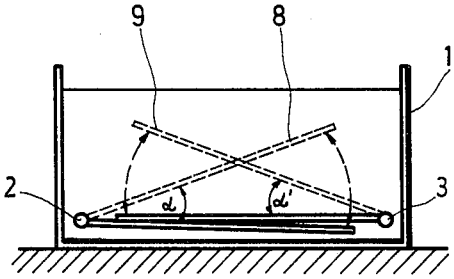
Fig.2
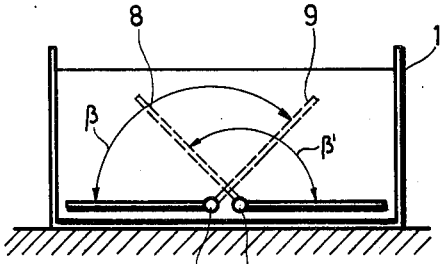
Fig.3
2 3

SHOT PEENING MACHINE WITH MIXER

CROSS REFERENCE TO RELATED APPLICATION

The present application is a continuation-in-part application of my copending Ser. No. 662,933 filed Mar. 1, 1976, and now abandoned.

BACKGROUND OF THE INVENTION

The invention relates to an apparatus for producing and maintaining a suspension of solids and liquids. The invention is especially suitable for producing and maintaining of suspensions which have a tendency to separate, in other words, in which the solids tend to rapidly settle down at the bottom of the container, for example, glass beads in water.

In order to maintain solids suspended in a liquid, it is necessary to maintain a continuous whirling movement, especially where the components of the suspension have a different specific weight or density. Well known means for sustaining such a whirling motion comprise, for example, a stirring device such as a rotating propeller, mixing worms or agitators. Reference is made in this connection, for example, to German Pat. No. 2,248,851. It is also known to maintain suspensions by means of circulating pumps which continuously withdraw a portion of the content of a container by means of a pump which accelerates that proportion through a closed loop piping system back into the container. Yet another known method for producing and maintaining a suspension blows an air stream into the container. The air bubbles rising in the container keep the suspension in motion.

However, it has been found that known methods have certain disadvantages, especially where a uniform mixing ratio is to be produced and maintained in a container, having a length of several meters. Thus, if in such a long container several rotating agitating devices are arranged along the length of the container, so-called slack or dead zones are created between two rotating agitators and close to the container wall. In these slack or dead zones, the solids tend to settle to the bottom of the container. Even where circulating pumps are employed, slack or dead zones can also not be entirely avoided because a satisfactory whirling motion occurs only in the immediate vicinity of the nozzles through which the accelerated jet of the liquid is introduced. Even air bubbles do not work entirely satisfactory because there is a tendency that the solids clog the air exit openings and because dead zones are also created around the air jets so that a completely uniform agitation throughout the volume of the container is not possible.

In a known wet blasting apparatus which is used for blasting large work pieces, for example, having a length of 12 meters and a width of 2 meters, the work piece is clamped in such a position that its longitudinal extension is horizontal and its width extends vertically. The blasting medium is, for example, water mixed with glass beads and is accelerated through one or several jet nozzles toward the work piece. A coordinate control mechanism is employed to move the nozzles so as to cover each point of the work piece or structural member. One or several funnels are arranged below the work piece for capturing the blasting medium running off the structural member or work piece. Where several funnels are employed it is necessary to provide a pipe system for returning the blasting medium or mixture into a stationary mixing container where the mixture is subjected to a strong whirling action so that the blasting medium, in the form of a suspension, may be transported by means of pressure pumps to the jets through flexible hose conduits. It has been found that such a wet blasting apparatus has several disadvantages. On the one hand, it is necessary that the collecting funnel has side walls which are inclined at an angle of at least 45°. Thus, if only one funnel is used, the apparatus has a rather large structural height, whereby it may become necessary to install the apparatus at two different floors or levels. On the other hand, where a plurality of collecting funnels are used, a rather expensive pipe conduit system must be used which is prone to trouble because depositions of the solids in the blasting medium cannot be prevented, whereby the system may not only be clogged but it is possible that such depositions conglomerate and return into the mixture in an uncontrolled manner, whereby the mixing ratio in the mixing container is influenced in an undesirable manner because uneven blasting conditions are the result, whereby it becomes impossible to achieve a defined, reproducible blasting effect on the surface of the work piece. Besides, the expensive hose conduit structure constitutes a constant source of trouble and even dangers.

OBJECTS OF THE INVENTION

In view of the above, it is the aim of the invention to achieve the following objects, singly or in combination:

to provide an apparatus for producing and maintaining a suspension, suitable for wet blasting devices, whereby it becomes possible to construct the wet blasting apparatus with a low overall structural height, whereby a blasting carriage may conveniently travel alongside an elongated, flat-bottomed mixing container;

to assure a reliable operation based on a constant, defined mixing ratio of the solid blasting component in the suspending liquid such as water;

to construct the mixing container and the mixing elements in such a manner that the apparatus may easily be integrated with a wet blasting system without unduly increasing the overall height of the wet blasting system;

to avoid the use of sleeve bearings, roller bearings, or ball bearings, which are sensitive to water and the blasting medium;

to drive the drive shafts for the agitating elements through an elastically responsive power limiting means; and to assure that, even after the solids have completely settled at the bottom of the mixing container, a rapid suspension of the solids is accomplished after the agitating elements start operation.

SUMMARY OF THE INVENTION

The apparatus of the invention makes it possible to prepare and maintain a suspension by moving agitating elements, such as baffle plates or the like, periodically up and down in an elongated flat mixing container. The apparatus according to the invention comprises a mixing container and drive shafts arranged in parallel to each other and horizontally, whereby the agitating elements are secured to these drive shafts for rotation through a limited angular range $\alpha$, $\alpha'$; $\beta$, $\beta'$, so that the resulting movement of the agitating elements inside the mixing container is substantially in a vertical direction.

These features of the invention have the advantage that an elongated flat-bottomed tank may be arranged below the work piece or structural element. The elongated, flat tank may function as a collecting chamber and/or as a mixing container. In such a structure it is possible to arrange the jet nozzles and the pump aggregate on a platform or carriage which is movable along the tank or container, for example, on rails, whereby the pumps may suck the suspension directly out of the tank at their respective instantaneous working position without interfering with the movement of the agitating elements. It has been found that the production and the sustaining or maintaining of the suspension inside the tank is efficiently accomplished by the agitating elements secured to drive shafts arranged horizontally and in parallel to each other so that the angular movement of the drive shafts results in a substantially vertical up and down movement of the agitating baffle plates inside the container, especially adjacent to the bottom thereof.

According to a further feature of the invention, the bearing or support means for the drive shaft comprise so-called torsion rubber bearings which are very simple in construction and reliable in operation substantially without maintenance as compared to sleeve bearings or roller or ball bearings which are rather sensitive relative to the water and the blasting medium, such as glass beads or the like. Such torsion rubber bearings avoid any sealing problems which are encountered with other types of bearings in this environment.

BRIEF FIGURE DESCRIPTION

In order that the invention may be clearly understood, it will now be described, by way of example, with reference to the accompanying drawings, wherein:

FIG. 1 is a perspective illustration of a mixing container in which the agitating elements intermesh in the manner of two combs and perform an up and down movement, whereby the drive shafts are secured in the lower corners and alongside the longitudinal edges of the mixing container.

FIG. 2 shows an end view of the container according to FIG. 1 with the end wall removed;

FIG. 3 shows a view similar to that of FIG. 2, however, of a modified embodiment in which the drive shafts are arranged in parallel to each other substantially in the center of the mixing container.

FIG. 4 is a schematic side view of a further embodiment of a mixing container, wherein the drive shafts for the agitating elements are arranged outside of the suspension and alongside the longitudinal walls of the mixing container;

FIG. 5 is a plan view of a perforated baffle plate;

DETAILED DESCRIPTION OF PREFERRED EXAMPLE EMBODIMENTS

Figure 7:
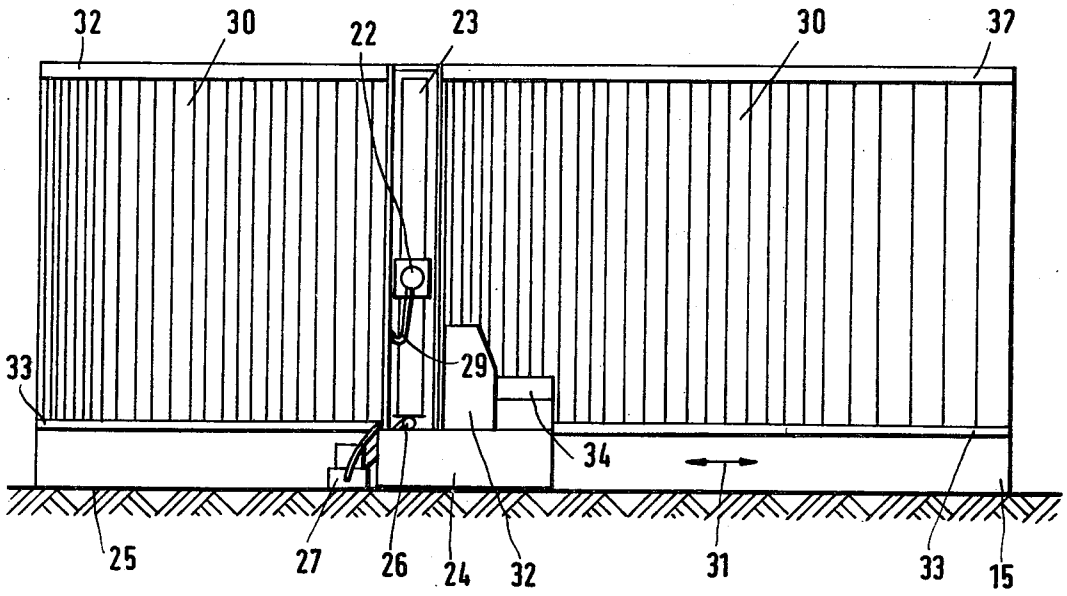
FIG. 7 is a side view of the system of FIG. 6.

FIG. 1 illustrates an apparatus for producing and maintaining a suspension. Two shafts 2 and 3 supported in bearings 4 and 5 as well as 6 and 7 are rotatably held in the lower corners and alongside the longitudinal corner edges of the container 1. A set of agitating members 8 is secured to the drive shaft 2. A further set of agitating members 9 is secured to the drive shaft 3. The agitating members are spaced from each other and positioned so that they intermesh like the teeth of two combs. The lower position of the agitating members 8, 9 is shown by dashed lines.

The shafts 2 and 3 are driven by a motor periodically up and down through angles $\alpha$ and $\alpha'$ whereby the movements may be in the same angular direction and/or in the opposite angular direction so that the free ends of the agitating members 8 and 9 are lifted and lowered as they perform substantially an up and down motion. In FIG. 2 the lower position of the agitating members 8 and 9 is shown in full lines, whereas the upper lifting position is shown in dashed lines.

The motion of the agitating members thoroughly agitates the liquid in a whirling manner throughout the volume of the mixing container, whereby the agitation is so strong that any solid components which initially rested on the bottom of the container become suspended in the liquid in a uniform distribution. Such uniform distribution has been tested by a mixture of water and quartz sand as well as by a mixture of water and glass beads.

FIG. 3 shows a further embodiment of the invention, wherein the two shafts 2 and 3 are secured by means of bearings to the bottom of the mixing container substantially along and adjacent to the center line of the bottom of the container. The agitating elements 8 and 9 perform an angular movement within the range of the angles $\beta$ and $\beta'$ in FIG. 3.

FIG. 4 shows a further embodiment of the invention in which the shafts 10 and 11 are supported outside the mixing container 14 adjacent to the upper edges of the longitudinal container walls. The angled shape of the agitation members 12 and 13 assures that a large surface area is effective adjacent to the bottom of the container. Thus, it is possible to make the effective agitating surface area substantially commensurate to the surface area of the container bottom.

FIG. 5 shows the plan view of a perforated baffle plate, which could be used instead of the baffle plates or agitating members 8 and 9 shown in FIG. 1.

Incidentally, with regard to FIG. 1 it should be mentioned that the drive shafts 2 and 3 are driven by a motor, preferably through an elastically yielding power limiting device such as a torque limiting clutch or the like. Such devices are well known in the art. The drive means are merely shown schematically for the drive shaft 3. The drive shaft 2 would be provided with the same type of drive means. These drive means would be driven in synchronism with each other, for example, the baffle plates 8 could move down while the baffle plates 9 move upwardly or vice versa.

The bearings 4, 5, 6, and 7 shown in FIG. 1 would preferably be so-called torsion rubber bearings because they are best suited for operation in the environment of the suspension itself inside the container shown in phantom lines in FIG. 1. In the embodiment of FIG. 4, it would not be necessary to use torsion rubber bearings, because the shafts 10 and 11 are supported outside the container 14.

The present apparatus operates as follows. Prior to starting the motor, the agitating elements 8 and 9 will preferably be held in a vertical position. This position in combination with the elastic power limiter between the motor and the drive shafts has the advantage that the apparatus is operational in the shortest possible time, even after a prolonged standstill, because due to the slanted dipping of the agitating plates into the layer of solids settled at the bottom of the container, the local pressure load on the layer of solids is rather substantial.

This is so, because the contact area between the agitating elements and the solids is initially small and only increases as the agitators continue to dip fully into the solids. The layer of settled down solids may comprise about 20 to 30% of the content of the tank. Nevertheless, the invention achieves a rapid suspension of the solids in the liquid in a uniform distribution due to a rapid and complete whirling of the solids upwardly. This has been confirmed in tests made with a suspension of glass beads in water.

Incidentally, the motor for the drive shafts 2, 3 would be of the reversible type so as to rotate the drive shafts only back and forth through a limited angular range.

Figure 6:
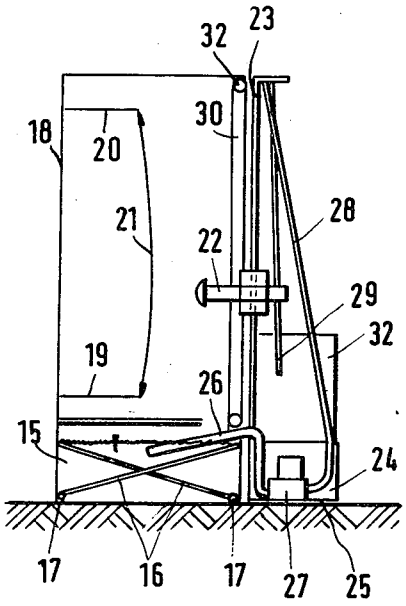
FIG. 6 shows schematically an end view of a wet blasting system according to the invention, wherein a blasting carriage is arranged for travelling alongside an elongated, flat-bottomed container.

Referring to FIG. 6 there is shown in a shematic manner, an end view of a wet blasting system according to the invention, wherein the container 15 may be of the type described above with reference to FIGS. 1 to 4. The agitating elements 16 are, for example, supported for movement by drive shaft 17 substantially as described with reference to FIG. 1.

Above the elongated, flat bottom container 15, there is supported a chamber 18 with conventional means not shown. Support arms 19 and 20 reach into the chamber 18 to hold a work piece, such as a piece of sheet metal 21, to be wet blasted by nozzle means 22 adjustably supported on an upright tower 23 which in turn is secured to a carriage 24 movable alongside of the container 15, for example, on rails 25.

An intake suction member 26 extends from the carriage 24 into the container 15. The intake suction member 26 has such a shape or bend, as not to interfere with the agitating movement of the agitating elements 16. The suction member 26 is connected to a pump 27 mounted on the carriage 24. The pressure output of the pump 27 is connected through a flexible hose 28 to the blasting nozzle 22. The hose 28 forms a loop 29 so as to permit the up and down adjustment or movement of the blasting nozzle 22.

The chamber 18 is provided with a flexible and adjustable front wall 30 which is constructed so as not to interfere with the movement of the nozzle 22 as the latter moves back and forth with the carriage 24 in the direction of the arrow 31 as shown in FIG. 7.

The adjustable, flexible wall 30 may, for example, be arranged in the form of a foldable bellows which will expand on the left side of the support tower 23 when the latter travels to the right in FIG. 7 and vice versa. The flexible, adjustable wall 30 may also simply be a sliding curtain supported at the top in a rail 32 and, if desired, also at the bottom to substantially prevent the spray from the nozzle 22 to escape from the chamber 18. However, a gap 33 of sufficient width is provided between the upper edge of the container 15 and the lower edge of the curtain 30 so that the suction intake 26 may travel alongside the upper edge of the container 15 without interference by the curtains 30.

The carriage 24 is also provided with a control panel 32 for controlling the pump 27 and the nozzle 22. Thus, only one flexible electrical supply conduit, not shown, is connected to the control panel 32 to power the motor for the pump 27. The details of the control panel are not part of the invention.

The advantages of a wet shot peening system, as illustrated in FIGS. 6 and 7 are seen in that due to the use of a flat bottomed container, the over-all structural height of the system has been substantially reduced and the use of mixing funnels as well as of a space accommodating mixing funnels of the prior art have been obviated. Furthermore, the cumbersome mixing pumps of the prior art have also been avoided which has the further advantage that substantial plumbing installations for the mixing pumps of the prior art are also avoided. The present hose connections 28 are rather simple since they travel along on the carriage 24, supported by the upright support or tower 23. Further, the entire power supply has been simplified, due to the arrangement of the control panel directly on the carriage. Incidentally, the flexible front wall 30 of the chamber 18 could be a transparent curtain so as to enable the operator to visually inspect the work piece 21 as it is being wet blasted. An operator's seat 34 may also be provided on the carriage 24.

Although the invention has been described with reference to specific example embodiments, it will be appreciated, that it is intended to cover all modifications and equivalents within the scope of the appended claims.

What is claimed is:

1. An apparatus for producing and maintaining a suspension having a tendency to rapidly separate comprising an elongated, stationary mixing container having a flat bottom and side walls, agitating elements in said container, drive shaft means to which said agitating elements are secured, first support means locating said drive shaft means to extend horizontally in such a manner that the movement of the drive shaft means within a predetermined angular range causes a substantially vertical up and down movement of said agitating elements in said mixing container, said apparatus further comprising rail means arranged alongside said stationary mixing container, carriage means arranged on said rail means for longitudinal movement alongside said elongated, stationary mixing container, further support means on said carriage means, jet nozzle means secured to said further support means for movement with said carriage means, stationary chamber means operatively arranged above said elongated, stationary mixing container to confine a work piece in said chamber means in such a manner that said nozzle means may travel along said work piece together with said carriage means, pump means mounted on said carriage means for movement with the carriage means and operatively connected to said nozzle means, said pump means including intake suction means connected to said pump means for longitudinal movement with said carriage means, said intake suction means reaching into said elongated, stationary mixing container, whereby the suspension is supplied to said nozzle means in a substantially uniform consistency throughout the length of said elongated mixing container as said carriage means travels along said elongated mixing container on said rail means, said intake suction means comprising an intake conduit movable therewith and having such a shape as to remain free of interfere with the agitating movement of said agitating elements when said intake conduit moves longitudinally through said stationary mixing container with the agitating elements moving in said container.

2. The apparatus of claim 1, wherein said drive shaft means are arranged adjacent to said bottom of said elongated mixing container.

3. The apparatus of claim 1, wherein said bottom and side walls of said elongated mixing container form longitudinal corners at the bottom of the container, said drive shaft means comprising at least two drive shafts arranged adjacent to and alongside to said longitudinal corners at the bottom of the elongated mixing container, said agitating elements comprising two sets of agitating elements each secured to its respective drive shaft with a spacing between each pair of adjacent agitating elements on the same drive shaft, said agitating elements on one drive shaft being staggered relative to the agitating elements on the other drive shaft, whereby the agitating elements on one drive shaft may pass through the spacings between the agitating elements on the other drive shaft and vice versa.

4. The apparatus of claim 1, wherein said elongated mixing container has side walls with longitudinal upper edges, said drive shaft means being arranged alongside said longitudinal upper edges outside of the mixing container, and wherein said agitating elements have two portions forming an angle with each other.

5. The apparatus of claim 4, wherein said drive shaft means have two drive shafts arranged in parallel to each other, and wherein said agitating elements have two sets one of which is secured to each drive shaft in staggered relationship such that the agitating elements of one set can pass through the agitating elements of the other set and vice versa.

6. The apparatus of claim 1, wherein said agitating elements are perforated.

7. The apparatus of claim 1, wherein said support means for said drive shafts are torsion rubber bearings.

8. The apparatus of claim 1, wherein said drive shaft means comprise two drive shafts arranged alongside each other substantially centrally of said mixing container and adjacent to the bottom of said mixing container.

9. The apparatus of claim 1, wherein said chamber means has flexible, adjustable wall means facing said further support means on said carriage means, said nozzle means extending through said flexible, adjustable wall means which permit the travel of said carriage means.

10. The apparatus of claim 1, wherein said flexible wall means is an adjustable curtain.

11. The apparatus of claim 1, further comprising control panel means mounted on said carriage means and operatively connected to said pump means.

* * * * *

UNITED STATES PATENT OFFICE

CERTIFICATE OF CORRECTION

Patent No. 4,154,539 Dated May 15, 1979

Inventor(s) Branko Sarh et al

It is certified that error appears in the above-identified patent and that said Letters Patent are hereby corrected as shown below:

Column 6, line 56, "interfere" should read --interference--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*